US009392360B2

(12) United States Patent
Andrea

(10) Patent No.: US 9,392,360 B2
(45) Date of Patent: Jul. 12, 2016

(54) STEERABLE SENSOR ARRAY SYSTEM WITH VIDEO INPUT

(71) Applicant: Andrea Electronics Corporation, Bohemia, NY (US)

(72) Inventor: Douglas Andrea, Sag Harbor, NY (US)

(73) Assignee: Andrea Electronics Corporation, Bohemia, NY (US)

( * ) Notice: Subject to any disclaimer, the term of this patent is extended or adjusted under 35 U.S.C. 154(b) by 26 days.

(21) Appl. No.: 14/319,707

(22) Filed: Jun. 30, 2014

(65) Prior Publication Data

US 2015/0003627 A1 Jan. 1, 2015

Related U.S. Application Data

(63) Continuation-in-part of application No. 13/291,565, filed on Nov. 8, 2011, now Pat. No. 8,767,973, which is a continuation of application No. 12/332,959, filed on Dec. 11, 2008, now Pat. No. 8,150,054.

(60) Provisional application No. 61/012,884, filed on Dec. 11, 2007.

(51) Int. Cl.

| | |
|---|---|
| ***H04R 1/40*** | (2006.01) |
| ***H04R 3/00*** | (2006.01) |
| *G10L 21/0216* | (2013.01) |

(52) U.S. Cl.

CPC ..... *H04R 1/406* (2013.01); *H04R 3/005* (2013.01); *G10L 2021/02166* (2013.01); *H04R 2430/23* (2013.01)

(58) Field of Classification Search

CPC ..... H04R 1/1083; H04R 2410/05; H04R 2410/07; H04R 3/00

USPC ..... 381/58, 71.7, 94.2, 92

See application file for complete search history.

(56) References Cited

U.S. PATENT DOCUMENTS

| | | | |
|---|---|---|---|
| 4,025,724 | A | 5/1977 | Davidson, Jr. et al. |
| 4,088,849 | A | 5/1978 | Usami et al. |
| 4,185,168 | A | 1/1980 | Graupe et al. |
| 4,630,305 | A | 12/1986 | Borth et al. |
| 4,894,820 | A | 1/1990 | Miyamoto et al. |
| 4,956,867 | A | 9/1990 | Zurek et al. |

(Continued)

FOREIGN PATENT DOCUMENTS

| | | |
|---|---|---|
| WO | WO 00/18099 | 3/2000 |
| WO | WO 00/49602 | 8/2000 |

(Continued)

OTHER PUBLICATIONS

Boll, "Suppression of Acoustic Noise in Speech Using Spectral Subtraction," Proc. IEEE Int. Conf. Acoustics, Speech, Signal Processing, Apr. 1979, vol. 27, pp. 113-120.

(Continued)

*Primary Examiner* — Md S Elahee

(74) *Attorney, Agent, or Firm* — Vedder Price P.C.; Thomas J. Kowalski; Rebecca G. Rudich

(57) ABSTRACT

Disclosed is a video controlled beam steering mechanism for an adaptive filter in a sensor array system that receives input from a target and applies an averaging filter and appropriately steers the beam. An adaptive filter is then used if the SNR of the output of the averaging filter reaches a threshold.

6 Claims, 9 Drawing Sheets

(56) References Cited

U.S. PATENT DOCUMENTS

| | | | | |
|---|---|---|---|---|
| 5,012,519 | A | 4/1991 | Adlersberg et al. | |
| 5,243,661 | A * | 9/1993 | Ohkubo | G10K 11/1784 381/94.2 |
| 5,263,019 | A | 11/1993 | Chu | |
| 5,459,683 | A | 10/1995 | Uesugi et al. | |
| 5,463,694 | A | 10/1995 | Bradley et al. | |
| 5,557,646 | A | 9/1996 | Honma | |
| 5,610,991 | A | 3/1997 | Janse | |
| 5,627,799 | A | 5/1997 | Hoshuyama | |
| 5,651,071 | A | 7/1997 | Lindemann et al. | |
| 5,815,582 | A | 9/1998 | Claybaugh et al. | |
| 5,825,897 | A | 10/1998 | Andrea et al. | |
| 5,825,898 | A | 10/1998 | Marash | |
| 6,035,048 | A | 3/2000 | Diethorn | |
| 6,049,607 | A | 4/2000 | Marash et al. | |
| 6,084,973 | A * | 7/2000 | Green | H04R 3/005 381/92 |
| 6,118,878 | A | 9/2000 | Jones | |
| 6,125,179 | A | 9/2000 | Wu | |
| 6,363,345 | B1 | 3/2002 | Marash et al. | |
| 6,377,637 | B1 | 4/2002 | Berdugo | |
| 6,430,295 | B1 | 8/2002 | Handel et al. | |
| 6,430,296 | B1 | 8/2002 | Olsen | |
| 6,449,586 | B1 | 9/2002 | Hoshuyama | |
| 6,453,289 | B1 | 9/2002 | Ertem et al. | |
| 6,483,923 | B1 | 11/2002 | Marash | |
| 6,728,380 | B1 | 4/2004 | Zhu et al. | |
| 6,959,092 | B1 | 10/2005 | Berkhoff et al. | |
| 7,054,452 | B2 | 5/2006 | Ukita | |
| 7,065,219 | B1 | 6/2006 | Abe et al. | |
| 7,092,529 | B2 | 8/2006 | Yu et al. | |
| 7,142,677 | B2 | 11/2006 | Gonopolskiy et al. | |
| 7,155,019 | B2 | 12/2006 | Hou | |
| 7,346,175 | B2 | 3/2008 | Hui et al. | |
| 7,415,117 | B2 | 8/2008 | Tashev et al. | |
| 7,471,798 | B2 | 12/2008 | Warren | |
| 7,475,014 | B2 | 1/2009 | Smaragdis et al. | |
| 7,478,041 | B2 | 1/2009 | Ichikawa et al. | |
| 7,630,502 | B2 | 12/2009 | Beaucoup et al. | |
| 7,711,127 | B2 | 5/2010 | Suzuki et al. | |
| 7,720,679 | B2 | 5/2010 | Ichikawa et al. | |
| 7,769,186 | B2 | 8/2010 | Stokes, III et al. | |
| 7,803,050 | B2 | 9/2010 | Mao et al. | |
| 7,809,145 | B2 | 10/2010 | Mao | |
| 7,817,805 | B1 | 10/2010 | Griffin | |
| 8,150,054 | B2 | 4/2012 | Andrea et al. | |
| 8,160,261 | B2 | 4/2012 | Schulein et al. | |
| 2004/0001598 | A1 | 1/2004 | Balan et al. | |
| 2004/0161121 | A1 | 8/2004 | Chol et al. | |
| 2004/0165735 | A1 | 8/2004 | Opitz | |
| 2005/0002535 | A1* | 1/2005 | Liu | H04H 60/04 381/58 |
| 2005/0207585 | A1 | 9/2005 | Christoph | |
| 2005/0281415 | A1 | 12/2005 | Lambert et al. | |
| 2006/0222184 | A1 | 10/2006 | Buck et al. | |
| 2006/0233389 | A1 | 10/2006 | Mao et al. | |
| 2006/0239471 | A1 | 10/2006 | Mao et al. | |
| 2006/0270468 | A1 | 11/2006 | Hui et al. | |
| 2007/0023851 | A1 | 2/2007 | Hartzell et al. | |
| 2007/0223731 | A1 | 9/2007 | Togami et al. | |
| 2007/0287380 | A1 | 12/2007 | Hui et al. | |
| 2008/0152161 | A1 | 6/2008 | Kim et al. | |
| 2008/0159559 | A1 | 7/2008 | Akagi et al. | |
| 2008/0175408 | A1 | 7/2008 | Mukund et al. | |
| 2008/0187152 | A1 | 8/2008 | Kim et al. | |
| 2008/0232607 | A1 | 9/2008 | Tashev et al. | |
| 2008/0317259 | A1 | 12/2008 | Zhang et al. | |
| 2009/0103749 | A1 | 4/2009 | Goodwin | |
| 2009/0129608 | A1 | 5/2009 | Puder | |
| 2009/0129609 | A1 | 5/2009 | Oh et al. | |
| 2009/0190774 | A1 | 7/2009 | Wang et al. | |
| 2009/0208028 | A1 | 8/2009 | Andrea et al. | |
| 2009/0268931 | A1 | 10/2009 | Andrea et al. | |
| 2010/0008518 | A1 | 1/2010 | Mao | |
| 2011/0129097 | A1 | 6/2011 | Andrea | |
| 2012/0057719 | A1 | 3/2012 | Andrea et al. | |

FOREIGN PATENT DOCUMENTS

| | | | |
|---|---|---|---|
| WO | WO 02/05262 | | 1/2002 |
| WO | WO 2006/028587 | A2 | 3/2006 |
| WO | WO 2008/146082 | A2 | 12/2008 |
| WO | WO 2008/157421 | A1 | 12/2008 |

OTHER PUBLICATIONS

Crochiere et al., "Multirate Digital Signal Processing," Prentice-Hall Inc., Englewood Cliffs, N.J., 1983.

Fischer et al., "An Adaptive Microphone Array for Hands-Free Communication," Proc. IWARNC-95, Røros, Norway, Jun. 1995.

Hirsch et al., "Noise Estimation Techniques for Robust Speech Recognition," Proc. IEEE Int. Conf. Acoustics, Speech, Signal Processing, 1995, vol. 1. pp. 153-156.

Kates et al., "A Comparison of Hearing-Aid Array-Processing Techniques," J. Acoust. Soc. Am. 99 (5), May 1996, pp. 3138-3148.

Kellermann, "Strategies for Combining Acoustic Echo Cancellation and Adaptive Beamforming Microphone Arrays," 1997.

Koizumi et al., "Acoustic Echo Canceller with Multiple Echo Paths," J. Acoust. Soc. Jpn. (E) 10, 1, 1989, pp. 39-45.

Kompis et al., "Noise Reduction for Hearing Aids: Combining Directional Microphones with an Adaptive Beamformer," J. Acoust. Soc. Am. 96 (3), Sep. 1994, pp. 1910-1913.

Kuo et al., "Multiple-Microphone Acoustic Echo Cancellation System with the Partial Adaptive Process," Digital Signal Processing 3, 1993, pp. 54-63.

Lyons, excerpts of "Understanding Digital Signal Processing," Oct. 1996, pp. 340-348.

Martin, "An Efficient Algorithm to Estimate the Instantaneous SNR of Speech Signals," Proc. Eurospeech, Sep. 1993, pp. 1093-1096.

Martin, "Spectral Substration Based on Minimum Statistics," Proc. EUSIPCO 1994, vol. II, pp. 1182-1185.

Oppenheim et al., "Digital Signal Processing," Prentice Hall, Inc., 1975, pp. 542-545.

Vaidyanathan, "Multirate Digital Filters, Filter Banks, Polyphase Networks, and Applications: A Tutorial," Proceedings of the IEEE, vol. 78, No. 1, Jan. 1990, pp. 56-93.

*Andrea Elec. Corp.* v. *Acer Inc. and Acer Am.*, Civil Action No. 2:14-cv-04488, Plaintiff's First Amended Complaint, Dkt. No. 1 (E.D.N.Y. Nov. 10, 2014) IPR 2015-1391 Ex 1002.

*Andrea Elec. Corp.* v. *Acer Inc. and Acer Am.*, Civil Action No. 2:14-cv-04488, Defendants' Answers and Defenses, Dkt. No. 32 (E.D.N.Y. Nov. 24, 2014) IPR 2015-1391 Ex 1003.

*Andrea Elec. Corp.* v. *Lenovo Holding Co. and Lenovo (U.S.) Inc.*, Civil Action No. 2:14-cv-04489, Plaintiff's First Amended Complaint, Dkt. No. 35 (E.D.N.Y. Nov. 10, 2014) . . . .

*Andrea Elec. Corp.* v. *Lenovo Holding Co. and Lenovo (U.S.) Inc.*, Civil Action No. 2:14-cv-04489, Defendants' Answers and Defenses, Dkt. No. 39 (E.D.N.Y. Nov. 24, 2014) . . . .

*Andrea Elec. Corp.* v. *Hewlett-Packard Co.*, Civil Action No. 2:15-cv-00208, Plaintiff's Complaint for Patent Infringement, Dkt. No. 1 (E.D.N.Y. Jan. 14, 2015) IPR 2015-1391 . . . .

*Andrea Elec. Corp.* v. *Dell Inc.*, Civil Action No. 2:15-cv-00209, Plaintiff's Complaint for Patent Infringement, Dkt No. 1 (E.D.N.Y. Jan. 14, 2015) IPR 2015-1391 Ex 1011.

*Andrea Elec. Corp.* v. *Acer Inc.*, Civil Action No. 2:15-cv-00210, Plaintiff's Complaint for Patent Infringement, Dkt. No. 1 (E.D.N.Y. Jan. 14, 2015) IPR 2015-1396 Ex 1004.

*Andrea Elec. Corp.* v. *Toshiba Corp.*, Civil Action No. 2:15-cv-00211, Plaintiff's Complaint for Patent infringement, Dkt. No. 1 (E.D.N.Y. Jan. 14, 2015) IPR 2015-1396 Ex 1005.

*Andrea Elec. Corp.* v. *Lenovo Holding Co and Lenovo (U.S.) Inc.*, Civil Action No. 2:15-cv-00212, Andrea Elec. Corp. Answer, Dkt. No. 21 (E.D.N.Y. Mar. 3, 2015) . . . .

*Andrea Elec. Corp.* v. *Realtek Semiconductor Corp.*, Civil Action No. 2:215-cv-00215, Plaintiff's Complaint for Patent Infringement, Dkt. No. 1 (E.D.N.Y. Jan. 14, 2015) . . . .

(56) References Cited

OTHER PUBLICATIONS

*Andrea Elec. Corp.* v. *Reaktek Semiconductor Corp.*, Civil Action No. 2:15-cv-00215, Court's Notice of Related Case, Dkt. No. 4. (E.D.N.Y. Jan. 21, 2015) IPR 2015-1391 Ex 1014.

In re Certain Audio Processing Hardward and Software and Products Containing Same, Inv. No. 337-TA-949, Notice of Institution of Investigation (U.S.I.T.C. Mar. 12, 2015) . . . .

* cited by examiner

STEERABLE SENSOR ARRAY SYSTEM WITH VIDEO INPUT

INCORPORATION BY REFERENCE

This application is a continuation-in-part of U.S. patent application Ser. No. 13/291,565, filed Nov. 8, 2011, now U.S. Pat. No. 8,767,973, issuing Jul. 1, 2014, which is a continuation of U.S. patent application Ser. No. 12/332,959, filed Dec. 11, 2008, now U.S. Pat. No. 8,150,054, issued Apr. 3, 2012, which claims the benefit of Provisional Application No. 61/012,884 filed Dec. 11, 2007. The present application also makes reference to Provisional Application No. 61/048,142 filed Apr. 25, 2008. All of these patents and applications are incorporated herein by reference.

Each document cited in this text ("application cited documents") and each document cited or referenced in each of the application cited documents, and any manufacturer's specifications or instructions for any products mentioned in this text and in any document incorporated into this text, are hereby incorporated herein by reference; and, technology in each of the documents incorporated herein by reference can be used in the practice of this invention.

BACKGROUND

In recent years, there has been a dramatic increase in the number of applications using voice communications. For instance, the Internet has allowed individuals to make telephone calls through a computer, or to talk to other people participating in an online multiplayer game. As such communications systems have evolved, it has become increasingly common for such individuals to not only desire audio communications, but also video connection to the other participants.

In some circumstances microphones can be built into a computer or monitor, or may be an external device which is attached to a computer or monitor. Due to the distance between such microphones and the user, such microphones must be able to receive input from a greater area. As a consequence, such microphones are also subject to picking up increased background noise.

Accordingly, there is a need for a high fidelity far field noise canceling microphone that possesses good background noise cancellation and that can be used in any type of noisy environment, as described in parent U.S. Pat. Nos. 8,767,973 and 8,150,054. Such sensor array systems are advantageous especially in environments where a lot of music and speech is present as background noise (as in a game arena or internet café), and a microphone that does not need the user to have to deal with positioning the microphone from time to time. In addition to the an integrated array of microphones utilizing an adaptive beam forming algorithm, the adaptive beam forming algorithm may be responsive to other input for beam forming available in the communication systems being used by the participants to provide enhanced beam forming. Such an invention allows a large degree of freedom because it considers inputs other than the audio received by the microphone sensor array and may therefore compensate for noise that may be captured by the beam forming algorithm having audio only input. Further, such a configuration allows a user to electronically steer the microphone's beam, or the area in which it accepts voice input, as opposed to having to physically steer the microphone array.

SUMMARY OF THE INVENTION

The present invention relates to a beam steering mechanism having adaptive filtering capabilities and methods of using the same to reduce background and related noise. The sensor array receives digital input from a number of channels and sources. First an averaging filter is applied to the input of each channel. The signal-to-noise ratio (SNR) of the output of the averaging filter is calculated. Depending on the SNR, a second filter, namely an adaptive filter would then be applied to the output of the averaging filter. The coefficients of this adaptive filter are updated on the basis of several calculated parameters such as a calculation of the beam of the sensor, a beam reference, a reference average, and noise estimation. These calculations are done on a continuous basis and the adaptive filter coefficients are also continuously updated.

The averaging filter and adaptive filter may be implemented on a digital signal processor or DSP. In other embodiments, general microprocessors, such as those found in computers may be used to perform the digital processing to implement filtering.

The sensor array itself can be made of microphones. If analog microphones are used the input must be digitized before the digital filtering begins. Alternatively, Digital microelectromechanical systems (MEMS) microphones can be used, wherein the microphone itself digitizes the input. As used herein, the terms microphone array and sensor array are used interchangeably. Any embodiments described as referring to a microphone array are equally applicable to a sensor array, and vice versa.

The sensor array device may also include a Video camera such that the system includes a sensor array having at least two sensors, the sensor array having one or more channels having as its output audio signals; a video camera having as its output a video reference signal; a processor receiving the audio signals from the sensor array and the video reference signal from the video camera; an adjustable beamformed audio capture region defined by said processor according to the audio signals and the video reference signal.

DETAILED DESCRIPTION

According to an embodiment of the current invention, a sensor array receives signals from a source. The digitized output of the sensors is then transformed using a discrete Fourier transform (DFT). Additionally, a video reference signal is generated to allow for motion tracking of objects that are sources of audio input in a "field of view" of the sensor array.

Figure 1:
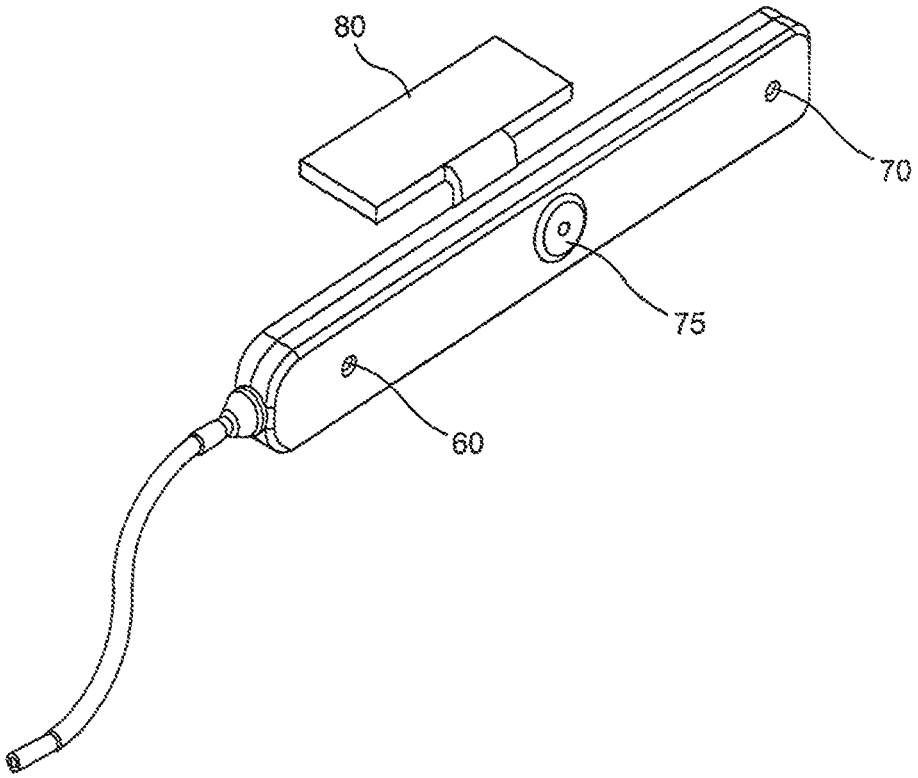
FIG. 1 is a drawing of a sensor array according to one embodiment of the invention.

The sensors of the sensor array preferably will consist of, but are not limited to, microphones. In one embodiment the microphones will be aligned on a particular axis. In the simplest embodiment, as shown in FIG. 1, the array will comprise two microphones, 60 and 70 on a straight line axis. Normally, the array will consist of an even amount of sensors, with the sensors, according to one embodiment, a fixed distance apart from each adjacent sensor. The sensor array can be designed with a mount 80 to sit or attach to or on a computer monitor, a video camera housing or similar.

Advantageously, a video camera 75 or some other type of device or sensor may fit or be located in-between the two most center microphones of the sensor array such that there is an equal amount of microphones on each side of the video camera or other device. According to an embodiment of the invention, the microphones generally will be positioned horizontally, and symmetrically with respect to a vertical axis. In such an arrangement there are two sets of microphones, one on each side of the vertical axis corresponding to two separate channels, a left and right channel, for example. The camera may be motorized and steered according to principles of the present invention.

In certain embodiments, the microphones will be digital microphones such as uni of omni-directional electret microphones, or micro machined microelectromechanical systems (MEMS) microphones. The advantage of using the MEMS microphones is that they have silicon circuitry that internally converts an analog audio signal into a digital signal without the need of an A/D converter, as other microphones would require in other embodiments of this invention. In any event, after the received audio signals are digitized, according to an embodiment of the present invention, the signals travel through adjustable delay lines that act as input into a microprocessor or a DSP. The delay lines are adjustable, such that a user can control the beam of the array. In one embodiment, the delay lines are fed into the microprocessor of a computer. In such an embodiment, as well as others described herein, there may be a graphical user interface (GUI) that provides feedback to a user. For example, the interface can tell the user the width of the beam produced from the array, the direction of the beam, and how much sound it is picking up from a source. Based on input from a user of the electronic device containing the microphone array, the user can vary the delay lines that carry the output of the digitizer or digital microphone to the microprocessor or DSP. As is well known in the areas of sensor array or antenna array technology, by changing the delay lines from the sensors, the direction of the beam can be changed. This allows a user then to steer the beam. For example, the microphone array might by default produce a beam direction that is directly straightforward from the microphone array. But if the target signal is not directly ahead of the sensor array, but instead at an angle with respect to the sensor array, it would extremely helpful for the user to steer the beam in the direction of the target source.

Allowing a person to steer the beam through electronic means is more efficient than requiring the manual movement of the device containing the sensor array. The steering ability allows the sensor array, including a microphone array, itself to be small and compact without requiring parts to physically move the sensors. In the case of an embodiment for use with a computer system or other similar electronic device, the software receiving the input would process the input through the GUI and properly translate the commands of user to accordingly adjust the delay lines to the user's wishes. The beam may be steered before any input or anytime after the sensor array or microphones receive input from a source. The beam may be steered according to information received from the microphones, e.g., phase information, or may be steered according to information received from other sensors, such as a video camera or infrared sensor, or may be steered manually. Moreover, any of these inputs could be used in combination to steer the beam.

Figure 2:
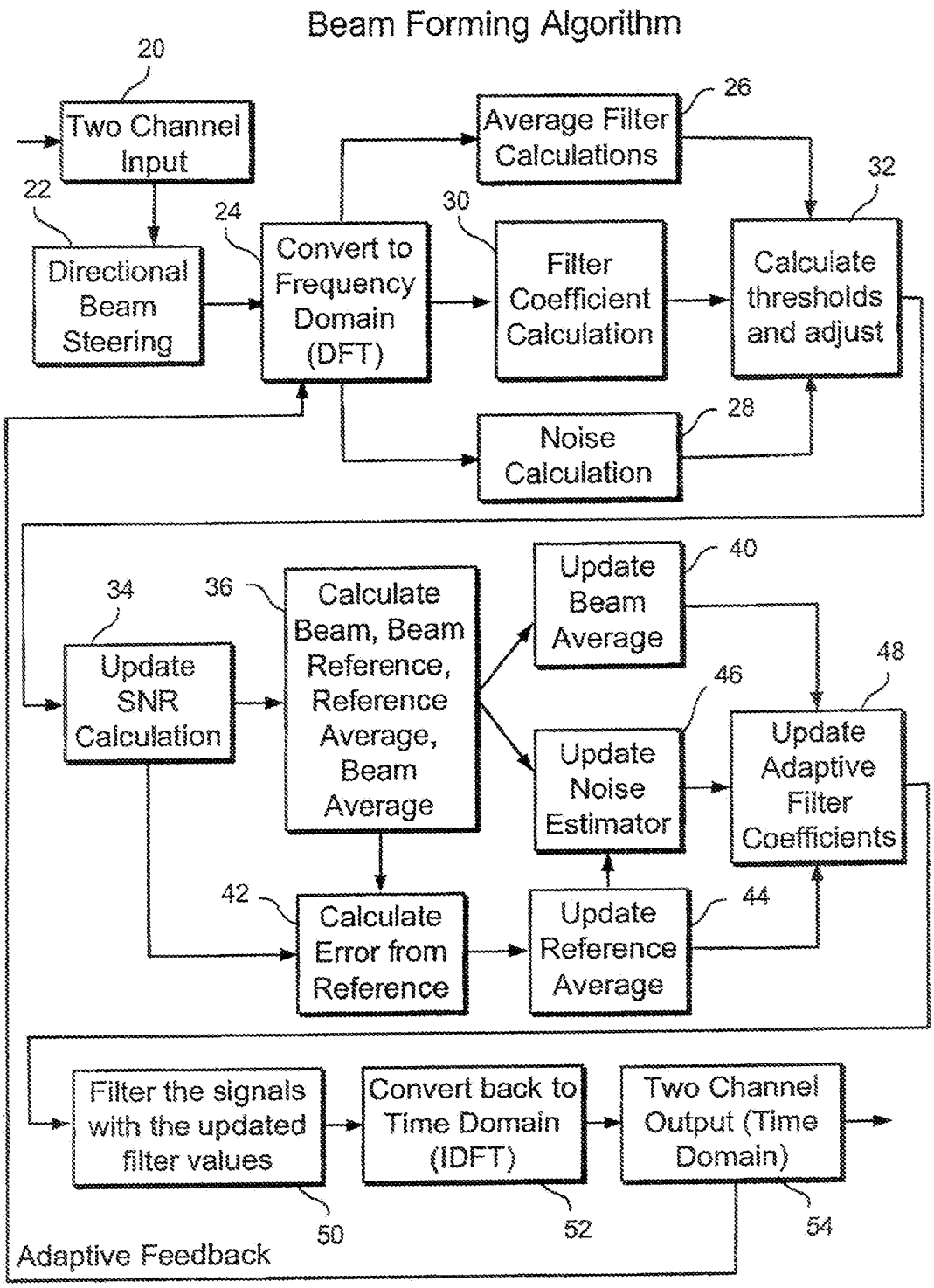
FIG. 2 is a schematic depicting the beam forming algorithm according to one embodiment of the invention.

As illustrated in FIG. 2, a beam forming system according to an embodiment may produce substantial cancellation or reduction of background noise. After the steerable microphone array produces a two-channel input signal that is digitized 20 and on which beam steering is applied 22, the output is transformed using a discrete fourier transform (DFT) 24. That is, data representation of the signals may be transformed between a frequency domain and a time domain using a DFT or the like. It is well known in the art that there are many algorithms that can perform a DFT. In particular, a fast Fourier transform (FFT) may be used to efficiently transform the data so that it is more amenable for digital processing. As mentioned previously, the DFT processing can take place in a general microprocessor, or a DSP. After transformation, the data can be filtered according to the embodiment of FIG. 2.

According to aspects of the present invention, an adaptive filter may be applied in order to greatly filter out background noise. The key is the way in which the adaptive filter is composed and in particular how the coefficients that make up the filter are produced. The adaptive filter is a mathematical transfer function. In one embodiment presented, the filter coefficient is dependent on the past and present digital input. Changes coefficients of the adaptive filter can change the shape of the beam to appropriate capture desired audio input and to filter out undesirable audio input (e.g., noise).

An embodiment as shown in FIG. 2 discloses an averaging filter that is first applied to the digitally transformed input in order to smooth the digital input and remove high frequency artifacts 26. This is done for each channel. In addition, the noise from each channel is also determined 28. Once the noise is determined, different variables can be calculated to update the adaptive filter coefficients. The channels are averaged and compared against a calibration threshold 32. Such a threshold is usually set by the manufacturer. If the result falls below a threshold, the values are adjusted by a weighting average function such as to reduce distortion by a phase mismatch between the channels.

Another parameter calculated, according the embodiment in FIG. 2, is the signal to noise ratio (SNR). The SNR is calculated from the averaging filter output and the noise calculated 34 from each channel. The result of the SNR calculation if it reaches a certain threshold will trigger modifying the digital input using the filter coefficients of the previous calculated beam. The threshold, which is typically set by the manufacturer, is a value in which the output may be sufficiently reliable for use in certain applications. In different situations or applications, a higher SNR may be desired, and the threshold may be adjusted by an individual, The beam for each input is continuously calculated. A beam is calculated as the average of signals, for instance, of two signals from a left and right channel, the average including the difference of angle between the target source and each channel. Along with the beam, a beam reference, reference average, and beam average are also calculated 36. The beam reference is a weighted average of a previous calculated beam and the adaptive filter coefficients. A reference average is the weighted sum of the previous calculated beam references. Furthermore, there is also a calculation for beam average, which is the running average of previous calculated beams. All these factors are used to update the adaptive filter.

Using the calculated beam and beam average, an error calculation is performed by subtracting the current beam front the beam average 42. This error is then used in conjunction with an updated reference average 44 and updated beam average 40 in a noise estimation calculation 46. The noise calculation helps predict the noise from the system including the filter. The noise prediction calculation is used in updating the coefficients of the adaptive filter 48 such as to minimize or eliminate potential noise.

After updating the filter and applying the digital input to it, the output of the filter is then processed by an inverse discrete Fourier transform (IDFT) to switch between the frequency domain and the time domain, as appropriate. After the IDFT, the output then may be used in digital form as input into an audio application, such as audio recording, voice over internet protocol (VOIP), speech recognition, or the output can be sent as input to another, separate computing system for additional processing.

According to another embodiment, the digital output from the adaptive filter may be reconverted by a D/A converter into an analog signal and sent to an output device. In the case of an audio signal, the output from the filter can be sent as input to another computer or electronic device for processing. Or it may be sent to an acoustic device such as a speaker system, or headphones for example.

The algorithm, as disclosed herein, is advantageously able to effectively filtering of noise, including non-stationary noise or sudden noise such as a door slamming. Furthermore, the algorithm allows superior filtering at lower frequencies while also allowing the spacing between elements in the array, i.e., between microphones, to be small, including as little as 2 inches or 50 mm in a two element microphone embodiment. Previously, microphones arrays would require substantially greater spacing, such as a foot or more between elements to be able to have the same amount filtering at the lower frequencies.

Another advantage of the algorithm as presented is that it, for the most part, requires no customization for a wide range of different spacings between the elements in the array. The algorithm is robust and flexible enough to automatically adjust and handle the element spacing a microphone array system might be required to have in order to work in conjunction with common electronic or computer devices.

Figure 3A:
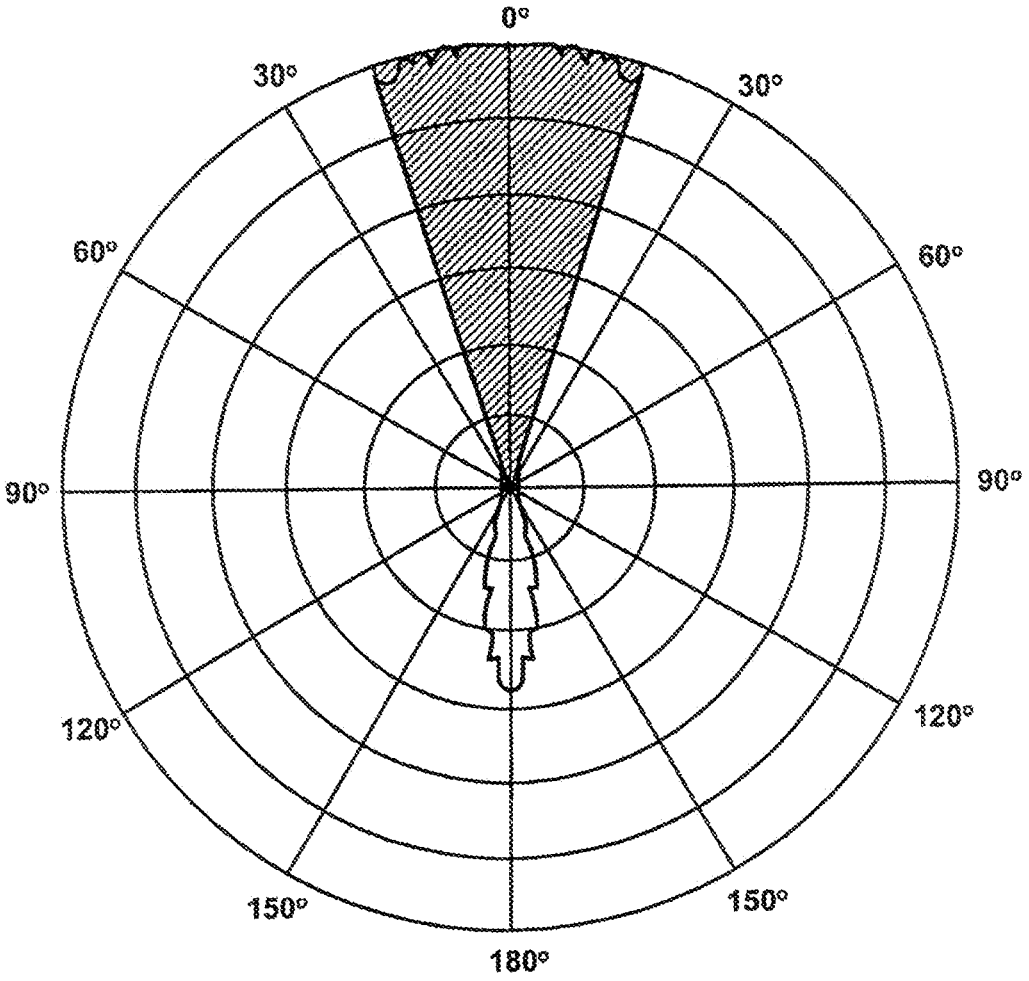
FIG. 3A is a drawing depicting a polar beam plot of a 2 member microphone array according to one embodiment of the invention.
Figure 4:
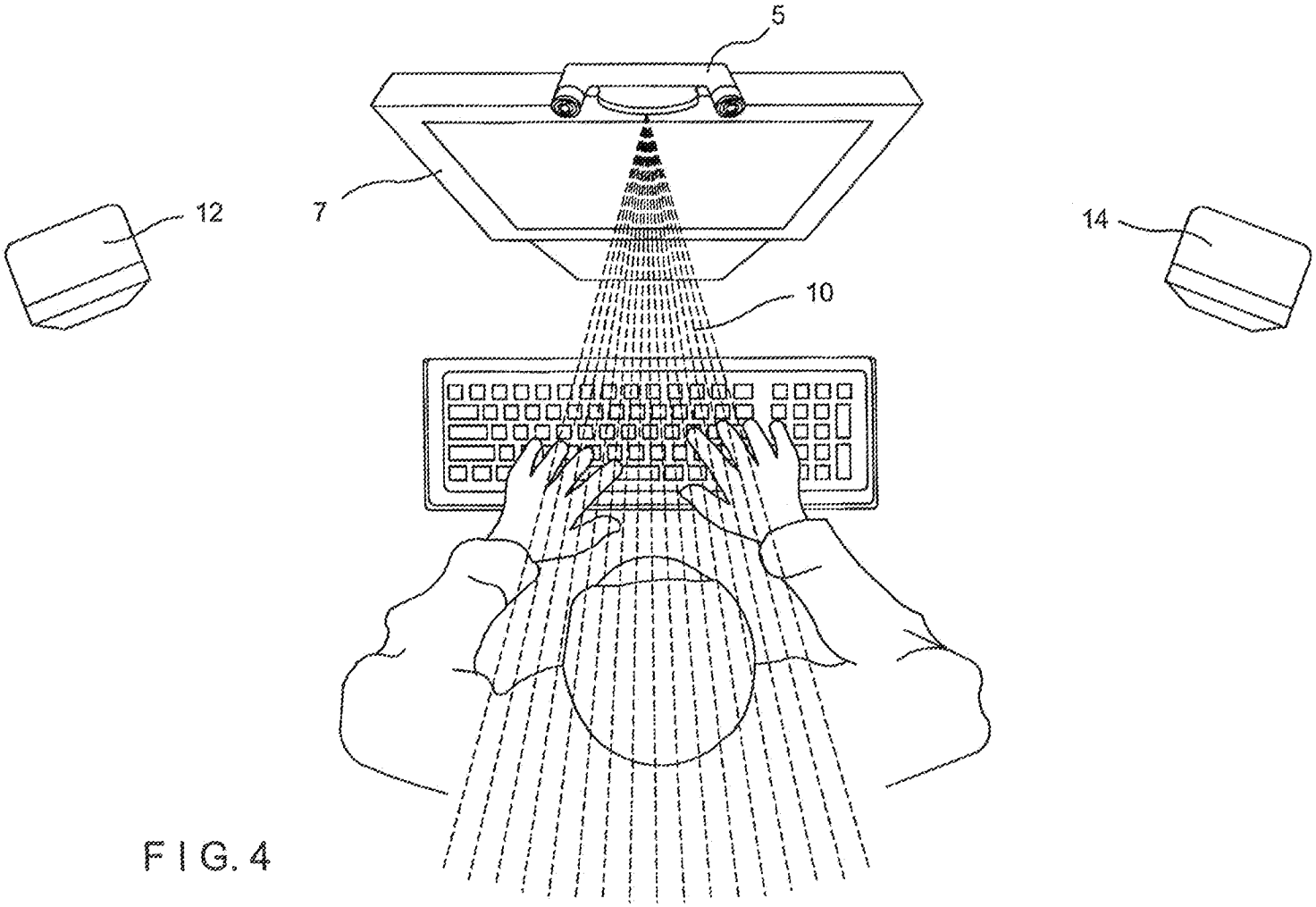
FIG. 4 is a drawing depicting the corresponding beam to the polar plot of FIG. 3 according to one embodiment of the invention.

FIG. 3A shows a polar beam plot of a 2 member microphone array according to an embodiment of the invention wherein the delays lines of the left and right channels are equal. FIG. 4 shows the corresponding beam as shown in the polar plot of FIG. 3A in an embodiment where the microphone array is used in conjunction with a computer system. The microphone array is placed a top a monitor in FIG. 4. In such an embodiment, the speakers are placed outside of the main beam, Because of the superior performance of the microphone array system, the array attenuates signals originating from sources outside of the main beam, such as the speakers as shown in FIG. 4, such that microphone array effectively acts as an echo canceller with there being no feedback distortion.

Figure 5:
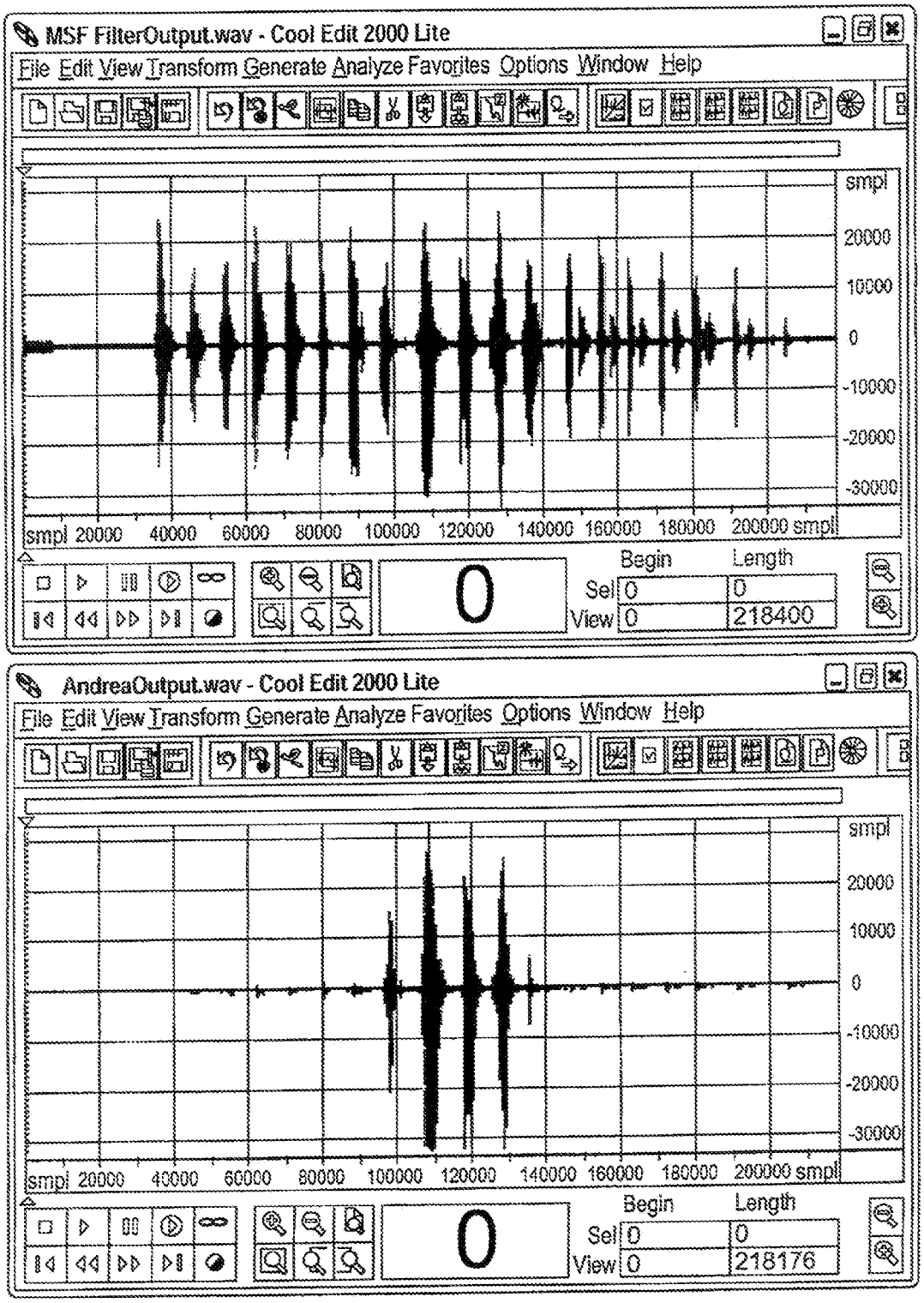
FIG. 5 depicts a comparison between the filtering, of Microsoft array filter with an array filter disclosed according to an embodiment of the present invention.

The beam typically will be focused narrowly on the target source, which is typically the human voice, as depicted in FIG. 4. When the target source moves outside the beam width, the input of the microphone array shows a dramatic decrease in signal strength as shown in FIG. 5. The 12,000 mark on the axis represents a target source or input source directly in front of the microphone array. The 10,000 mark and 14,000 mark correspond to the outer parts of the beam as shown in FIG. 3A. FIG. 5 shows, for example, a comparison between the filtering of a Microsoft array filter with an array filter according to an embodiment of the present invention. As soon as the target source falls outside of the beam width, or at the 10,000 or 14,000 marks, there is a very noticeable and dramatic roll off in signal strength in the microphone array using an embodiment of the present invention, By contrast, there is no such roll off found in the Microsoft array filter.

In the case where there may be more than one human voice or person whose speech should be captured by the array, it may be preferable to adjust the beam to make the beam wider. To produce a wider beam, different combinations of microphones can be selected, the microphones may be physically moved or the coefficients of the beam forming algorithm may be adjusted. Also, it is contemplated that input sources other than audio may be considered in adjusting the coefficients of the beam forming algorithm automatically, semi-automatically, or manually.

For example, besides GUI control that allows semi-automatic or manual control of the beam steering function previously described in the specification, the array microphone beam can also be controlled and steered according to a reference signal from an integrated video camera system. The video camera system includes at least one video camera, such as video camera 75. The video camera system may include a separate processor or may utilize a processor as previously described herein. The video camera system performs object motion tracking using an optical tracking algorithm. The optical tracking algorithm may be performed in a microprocessor dedicated to the video camera system or may be performed in a shared processor. The video camera system may include any known video camera. In addition, the system my include other types of motion sensors, including one or more an I/R sensors or other gesture or movement detectors.

Figure 6:
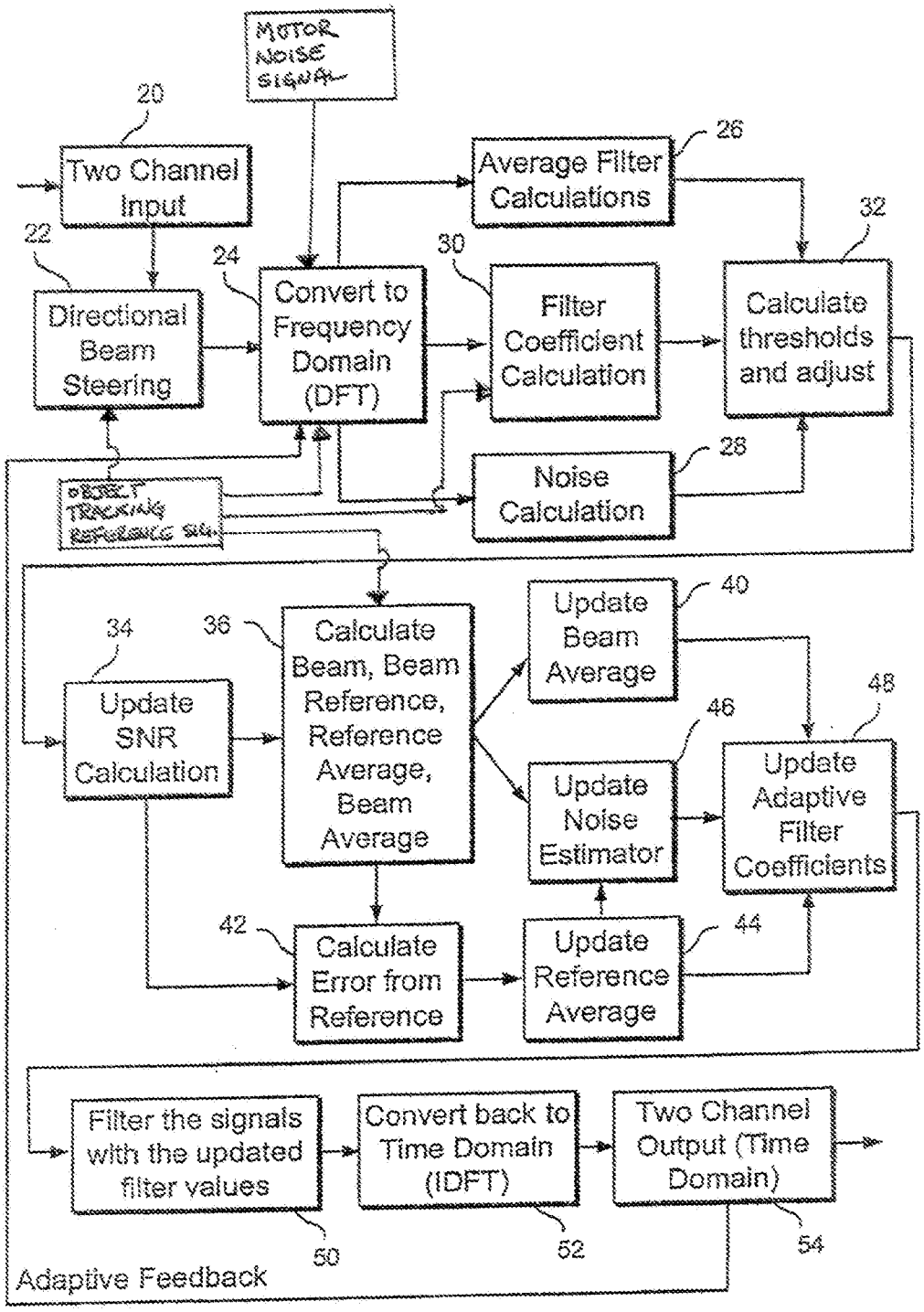
FIG. 6 is as schematic depicting the steering algorithm according to an embodiment of the invention.

Moreover, the Video camera itself, which may be motorized, may be steered according to the both the audio and video inputs or other sensor inputs described herein. That is, a video face/target detection and tracking algorithm may be used for reference signal to steer the microphone beam and to control a motorized camera's Left/Right pan direction. As illustrated in FIG. 6, such video reference signal or object tracking reference signal could be input to the Direction Beam Steering 22, the Time to Frequency Domain Converter 24, coefficient calculation 30 and/or into the Beam Calculation 36 of FIG. 2. The motorized video camera may be generally synchronized with the adjustable beam.

Similarly, the beam may be steered based on the number, location or movement of faces identified by the video camera (or I/R system), e.g., number of faces in the field of view and movement of the targets. The beam may be steered regardless of whether the beam is widened or narrowed or remains the same, or it may be steered in addition to changing the width of the beam. The beam may be steered by software control or manually in order to produce phase delay to create a beam.

Also, the beam may be automatically steered if faces within the field of view move. For example, motion tracking software hosted by the processor receives/captures left/right (L/R) directional information. The processor sends this UR horizontal directional information to the beam steering interface of the array microphone function driver to create a video reference signal (video ref) or object tracking reference signal. Therefore the array microphone sensitivity "beam" will be guided by the video of signal/object tracking reference signal and follow the direction of the moving person/target in front of the camera. As illustrated in FIG. 6, such video reference signal or object tracking reference signal can be used to adjust the coefficients of the beam forming algorithm.

Figure 3B:
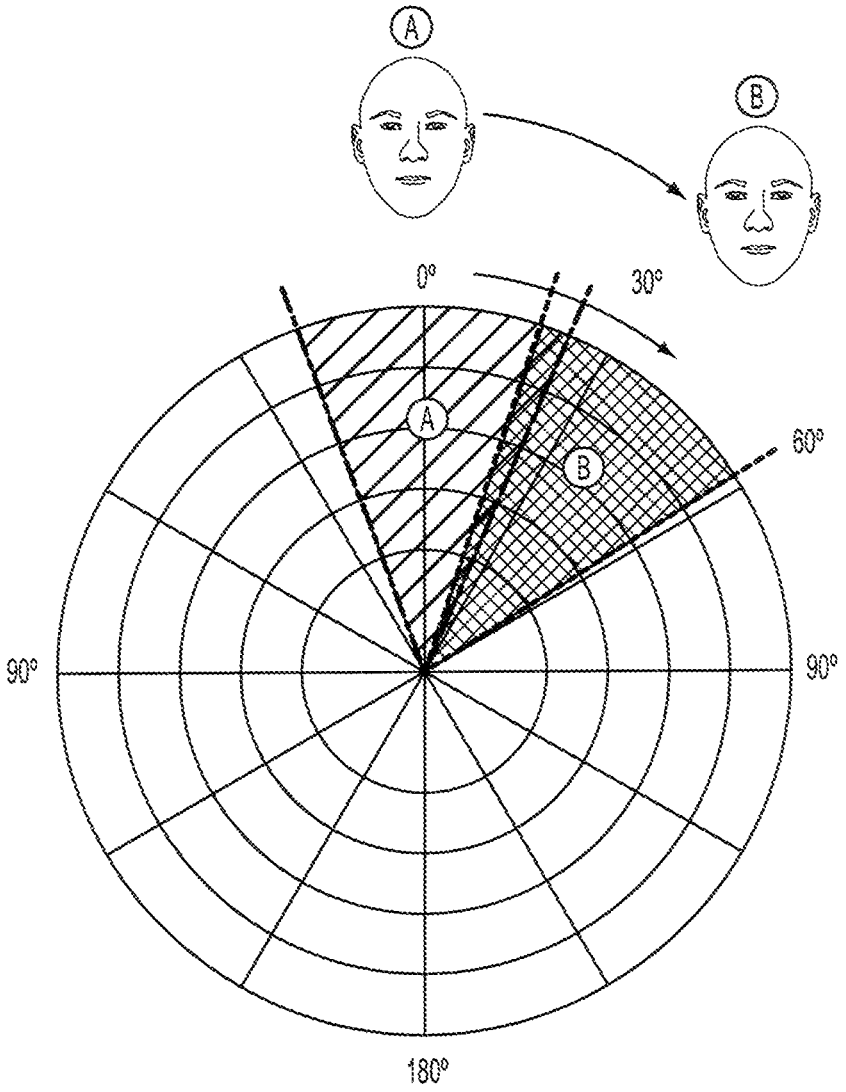
FIG. 3B is a drawing depicting a polar beam plot illustrating a beam moving from to follow a user's face.
Figure 3C:
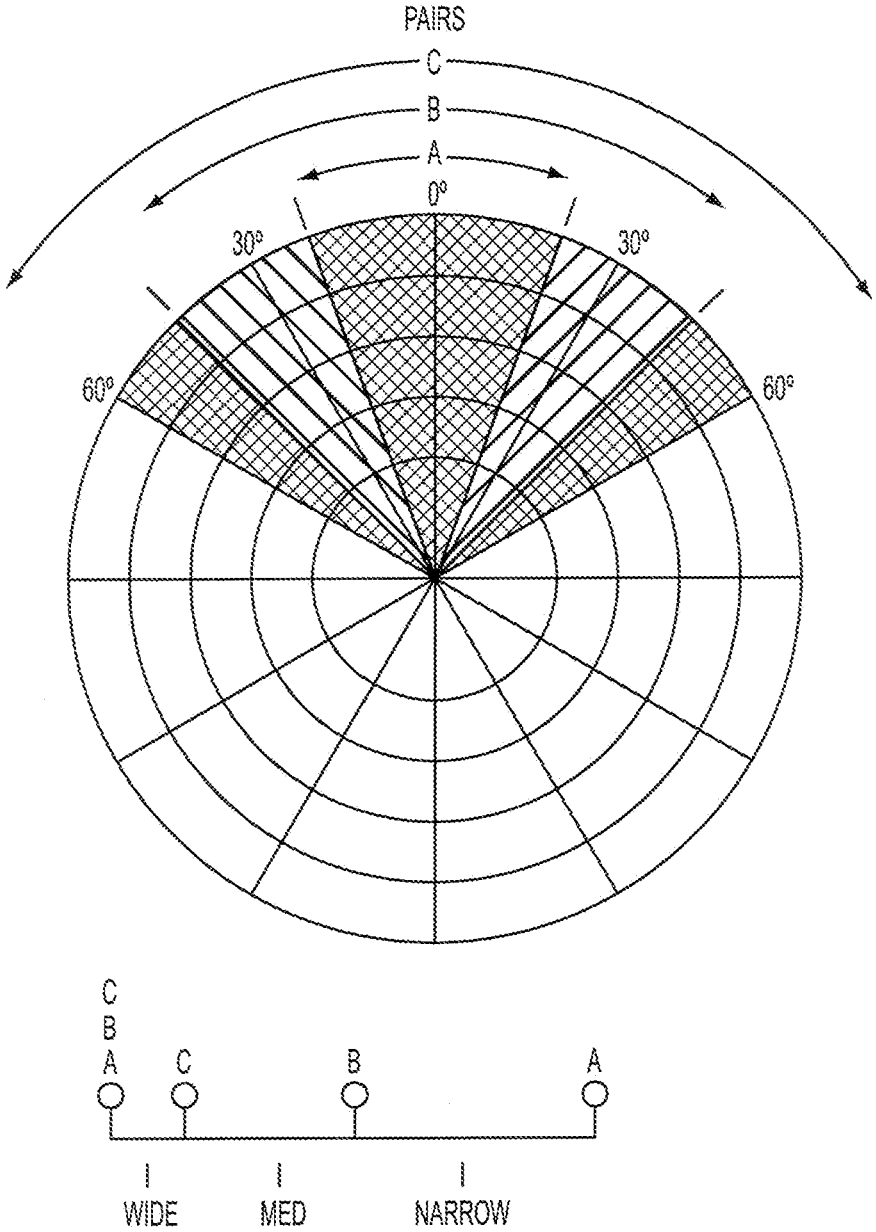
FIGS. 3C and 3D illustrate polar beam plots following multiple faces or targets according to various sensor inputs according to principles of the present invention.
Figure 3D:
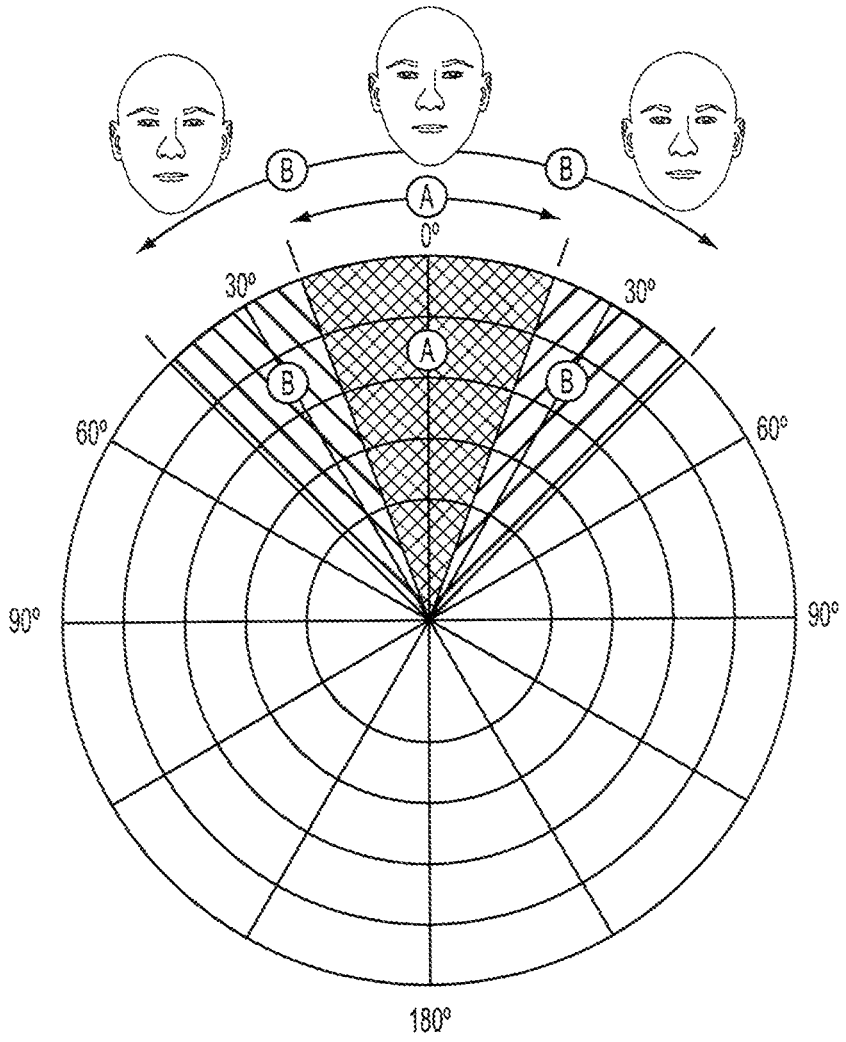

For example, in the event that more than one person is within view of the video camera, or a single user is moving within the view of the video camera and/or microphone range, and may provide input to the sensor array (e.g., may speak to provide input to microphone array), the video camera may identify the faces within the camera field and coefficients in the beam forming, algorithm may be adjusted manually or automatically, or some combination thereof, to take into account the identified faces as input sources. For example, facial recognition software such as used in digital camera technology may be used. For example, one or two faces in the field of view may provide an alert to widen the beam formed by the microphones to pick up the input from the identified faces or as the faces move. Such beams may be partially or wholly adjusted automatically based on location of the sound source and/or the video identification of a face or faces or it may provide only an alert that the beam should be widened manually, for example by using different combinations of microphones, adjusting coefficients electronically or physically moving microphones, or some combination thereof. An exemplary polar plot of a beam moving from approximately 0 degrees to approximately 35 degrees to follow a user's face is illustrated in FIG. 3B, Video detection of multiple faces/targets can provide a control signal to change to a desired beam width via algorithm adjustment or selection of differently spaced microphone pairs, as illustrated in FIG. 3C, AA (narrow beam width), BB (medium beam width) or CC (wide beam width). Such control signal would typically be input to calculation of the beam, see box 36 of FIG. 2. For example, the beam may be widened to capture a larger area of desired targets or narrowed to "focus" the beam in on a desired target/direction in the field of view. In addition, multiple microphones or microphone sensor arrays may be used for multiple people, as illustrated in FIG. 3D, such that the beam may be adjusted accordingly according to the microphone beam and video reference signals.

The objective of video tracking is to associate target objects in consecutive video frames. These video tracking systems generally employ a motion model, which describes how the image of the target might change for different possible motions of the object. Examples of simple motion models are a 2D transformation (affine transformation or homography) of an image of the object (e.g. the initial frame) when tracking planar objects. For rigid a 3D object, the motion model defines the object's aspect depending on the object's 3D position and orientation. In one example, a 2-dimensional camera can sense pixels moving, The 2D camera can be resident in a set top box, home automation or a computer, such as a notebook computer, integrated fiat panel display or the like.

For video compression, key frames may be divided into macroblocks. The motion model may be a disruption of a key frame, where each macroblock is translated by a motion vector given by the motion parameters. The image of deformable objects can be covered with a mesh, the motion of the object is defined by the position of the nodes of the mesh, To perform video tracking, an algorithm may analyze sequential video frames and outputs the movement of targets between the frames. There are two major components of a visual tracking system: target representation and localization, as well as filtering and data association.

Also, target representation and localization can provide a variety of tools for identifying the moving object. Locating and tracking the target object successfully is dependent on the algorithm. For example, using blob tracking is useful for identifying human movement because a person's profile changes dynamically. Typically the computational complexity for these algorithms is low. The following are some common target representation and localization algorithms: Blob tracking: segmentation of object interior (for example blob detection, block-based correlation or optical flow); Kernel-based tracking (mean-shift tracking): an iterative localization procedure based on the maximization of a similarity measure (Bhaitacharyya coefficient); Contour tracking: detection of object boundary (e.g. active contours or Condensation algorithm).

Video tracking and microphone beam steering system according to the present principles may include, for example, a personal computer with video camera and array microphone, a television set top box with video camera and array microphone, a game console set top box with video camera and array microphone, home automation video camera with array microphone, video security sytems, robots, wall mounted control panel interface with video camera and array microphone or the like.

Additionally, other uses can include cancellation of embedded noise caused by a motorized camera, for example, in an all-inclusive security camera system. For example, an auto pan type or motorized camera could additional provide a motor RPM reference signal for canceling that noise by inputting the noise signal into the beam forming algorithm, perhaps into the Time to Frequency Domain Converter 24 to be used in the noise and filter calculations, as illustrated in FIG. 6.

Also, principles of the present invention can be applied in the field of robotics. Namely, a video tracking and microphone beam steering system according to the present invention can be incorporate input video or other visual sensor, microphones or sensors that are resident in a robot or other electro-mechanical or virtual artificial agent that interacts with or is responsive to sound or voice. For example, the robotic device may include a motorized camera that is capable of being steered according to the present system using video reference inputs, audio/microphone inputs or a combination thereof. Moreover, where desired, the entire robot device may be directed according to the present system using video reference inputs, audio/microphone inputs or a combination thereof to direct the robotic device, for example, toward the source or target.

As one of skill in the art would recognize, in the invention as disclosed, the sensor array could be placed on or integrated within different types of devices such as any devices that require or may use an audio input, such a computer system, laptop, cellphone, global positioning system, audio recorder, etc. For instance, in a computer System embodiment, the microphone array video camera system may be integrated, wherein the signals from the microphones/camera are carried through delay lines directly into the computer's microprocessor. The calculations performed for the algorithm described according to an embodiment of the present invention may take place in a microprocessor, such as an Intel Pentium Processor, typically used for personal computers. Alternatively, the processing may be done by a digital signal processor (DSP). The microprocessor or DSP may be used to handle the user input to control the adjustable lines and the beam steering.

Alternatively, in a computer system embodiment, the microphone array and the delay lines can be connected, for example, to a USB input instead of being integrated with a computer system. In such an embodiment, the signals may then be routed to the microprocessor, or it may be routed to a separate DSP chip that is also connected to the same or different computer system for processing. The microprocessor of the computer in such an embodiment could still run the GUI that allows the user to control the delays and thus control the steering of the beam, but the DSP will perform the appropriate filtering of the signal according to an embodiment of an algorithm presented herein.

In some embodiments, the spacing of the microphones in the sensor array or camera(s) may be adjustable. By adjusting the spacing, the directivity and beam width of the sensor can be modified. In some embodiments, if a video sensor or camera is placed in the center of the microphone array it may be preferable to have the beam width the same as the optical viewing angle of the video camera or sensor.

Having thus described in detail preferred embodiments of the present invention, it is to be understood that the invention defined by the foregoing paragraphs is not to be limited to particular details and/or embodiments set forth in the above description, as many apparent variations thereof are possible without departing from the spirit or scope of the present invention.

The invention claimed is:

1. A sensor array device, comprising:

a sensor array having at least two sensors, the sensor array having one or more channels having as its output audio signals;

a video camera having as its output a video signal and an object tracking reference signal;

a processor receiving the audio signals from the sensor array and the object tracking reference signal from the video camera; and an adjustable beamformed audio capture region defined by said processor according to the audio signals and the object tracking reference signal, wherein a beam of said adjustable beamformed audio capture region is adjusted based on the audio signals and the object tracking reference signal and applying an adaptive filter to a filtered signal wherein coefficients of the adaptive filter are updated based on the adjusted beam.

2. The sensor array device of claim 1, wherein said video camera is a motorized camera steerable according to audio signals and the object tracking reference signal.

3. The sensor array device of claim 1, wherein the sensor array is an audio receiving system and the video camera is an integrated video camera array, the device further comprising a camera motor noise reference signal to further cancel motor noise from the integrated video camera array and the audio receiving system.

4. The sensor array device of claim 2, wherein the motorized video camera is generally synchronized with the adjustable beamformed audio capture region.

5. The sensor array device of claim 1, wherein the at least two sensors include at least two microphones.

6. The sensor array device of claim 5, wherein the video camera is located between the at least two sensors.

* * * * *